United States Patent [19]

Johnson

[11] Patent Number: 4,566,209

[45] Date of Patent: Jan. 28, 1986

[54] BOOT WITH EXPANDING WEBS

[76] Inventor: James R. Johnson, 4361 Ivory Way, NE., Salem, Oreg. 97305

[21] Appl. No.: 627,914

[22] Filed: Jul. 5, 1984

[51] Int. Cl.[4] ..... A43B 5/00

[52] U.S. Cl. ..... 36/116; 36/7.7

[58] Field of Search ..... 36/116, 122, 123, 124, 36/125, 72 R, 2 R, 7.1 R, 7.7

[56] References Cited

U.S. PATENT DOCUMENTS

| | | | |
|---|---|---|---|
| 1,266,492 | 5/1918 | Schneider et al. | 36/116 X |
| 2,367,219 | 1/1945 | Kearny | 36/116 X |
| 2,872,745 | 2/1959 | Finegan | 36/72 R X |
| 3,082,548 | 3/1963 | Hartman | 36/116 |
| 3,747,236 | 7/1973 | Sidlauskas | 36/116 |
| 3,783,532 | 1/1974 | Harradine | 36/116 |
| 4,447,969 | 5/1984 | Johnson | 36/116 |

*Primary Examiner*—Werner H. Schroeder
*Assistant Examiner*—T. Graveline
*Attorney, Agent, or Firm*—Charles N. Hilke

[57] ABSTRACT

Unique front expanding webs and rear expanding web increase the surface area for a boot or boot add-on for walking on sand, mud, snow, marshes, or other soft material. The front expanding webs and rear expanding web further provide load bearing support to the boot or boot add-on.

4 Claims, 10 Drawing Figures

BOOT WITH EXPANDING WEBS

BACKGROUND OF THE INVENTION

This invention is an improvement upon the applicant's prior patent in this area entitled "A Boot for Walking on Soft Materials," U.S. Pat. No. 4,447,969. The improvement increases the effective surface area while simplifying the design of the boot or boot add-on. Furthermore, the simplier design has additional safety features. References made of record in the prior patent are: U.S. Pat. No. 3,747,236, Sidlauskas and U.S. Pat. No. 3,783,532, Haradine.

SUMMARY OF THE INVENTION

The present invention uses two appropriately hinged and supported wings which open on contact with the soft material additionally spreading two front expanding webs, heel plate, and rear expanding web. One embodiment retains a solid hinge structure with fixed wing stops, whereas the second embodiment depends solely on the side fabric hinge and reinforced expanding webs for support. Both embodiments can be constructed as an integral part of boots or can be boot add-ons attached to boots. The boot add-on comprises the foot support, wings, rear web, rear flexible web, front flexible web and fasteners.

It is the primary object of the improvement to provide a larger surface area in contact with the soft material.

A further object is to provide additional safety.

Another further object is to provide a chamber for trapping air on the underside of the wings which displaces soft material around the hinge to prevent fouling and to counteract resistance caused by friction and suction.

To the accomplishment of the foregoing and related ends, the invention, then, comprises the features hereinafter fully described and the annexed drawing setting further in detail certain illustrative embodiments of the invention, these being indicative, however, of but several of the various ways in which the principle of the invention may be employed.

BRIEF DESCRIPTION OF THE DRAWINGS

So that the invention may be readily made, reference is made to the accompanying drawings:

FIG. 1 is a side view of the solid hinge with fixed stops boot add-on.

FIG. 6 is an exploded perspective view of the solid hinge with fixed stops boot add-on.

DETAILED DESCRIPTION OF THE INVENTION

Figure 1:
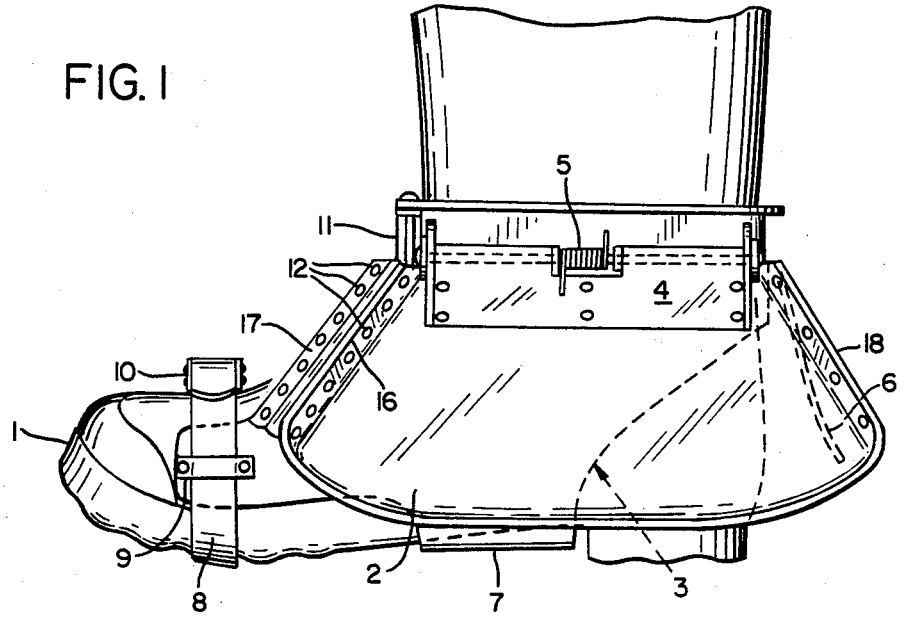

FIG. 1 shows the embodiment for the solid hinge boot add-on with fixed stops. The boot 1 is within the foot support 3 and held in place by swing front spreader 11 and toe belt fastener 10. The spring hinge 5 is centered in the wing support 4 which is attached to wing 2 by means of rivets 12. The stirrup 7 is under the boot 1 and the heel plate 6 is shown behind the wing 2. A belt loop 9 is attached to the foot support 3 and the toe belt 8 slides through belt loop 9.

Figure 2:
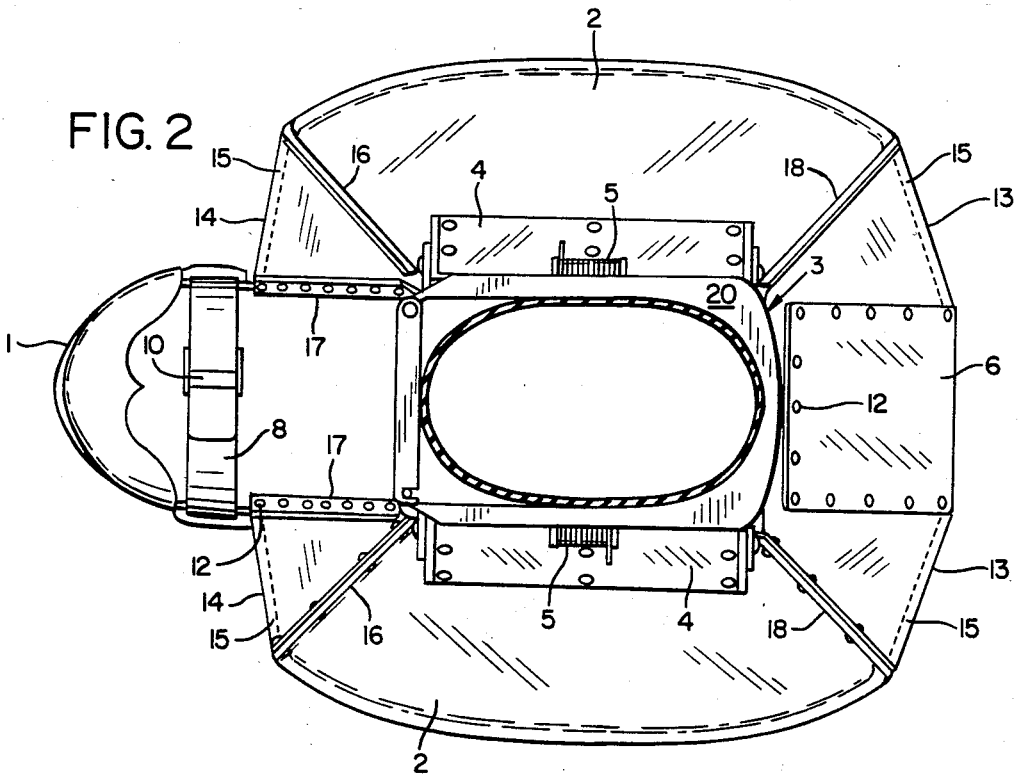
FIG. 2 is a top view of the wings and expanding webs in open and spread position.

FIG. 2 shows the wings 2 opened. Heel plate 6 attached to rear expanding web 13 also is shown spread. Rear expanding web 13 is attached to both the wing 2 and the heel plate 6. Both front expanding webs 14 are shown spread where each is attached to the foot support 3 and wing 2. The top of the foot support 20 is shown.

Figure 3:
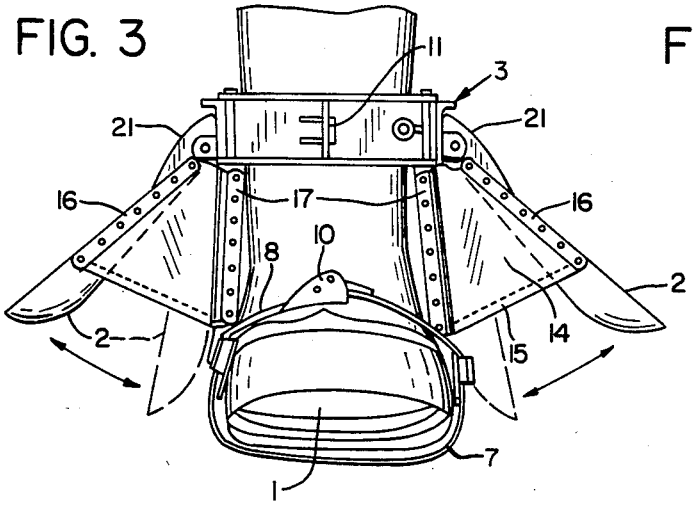
FIG. 3 is a front view showing the wings open and in rest position.

FIG. 3 shows a front view where the wing stop 21 is shown pressed against the foot support side 24. The front web-wing mounting plate 16 and the front web-foot support mounting plate 17 is shown. The reinforced hem 15 is shown on the front expanding web 14.

Figure 4:
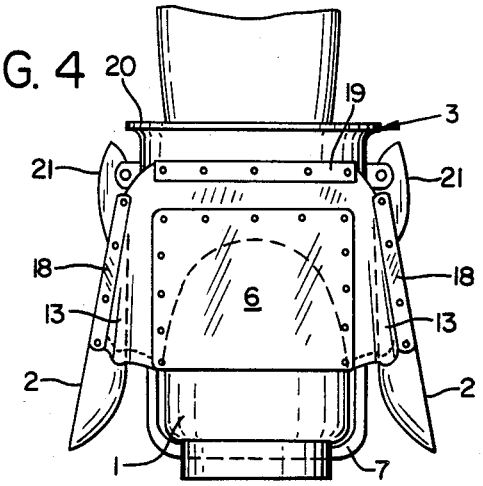
FIG. 4 is a rear view showing the wings and rear expanding web in rest position.

In FIG. 4, a rear view is shown with the rear web-wing mounting plate 18 and the rear web-foot support mounting plate 19 attaching the rear expanding web 13 to the foot support 3 and wing 2. The wing stop 21 is shown in rest position.

Figure 5:
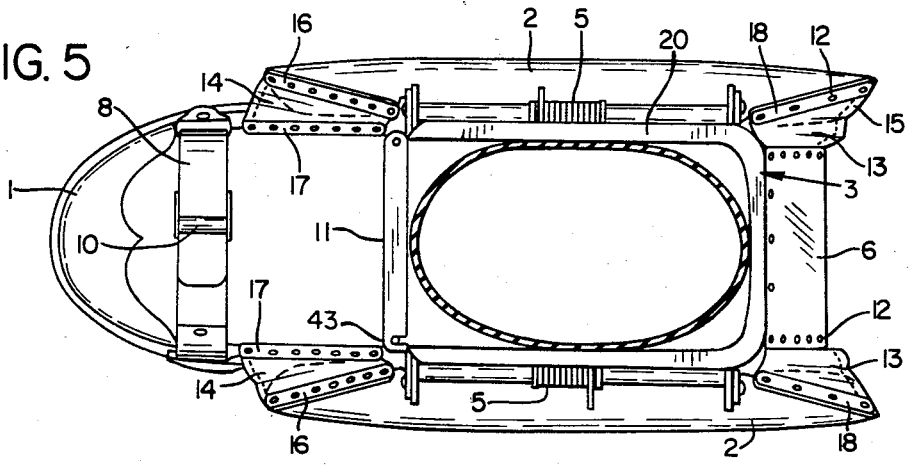
FIG. 5 is a top view with the wings and expanding webs in rest position.

FIG. 5 shows the wings 2 in rest position. The heel plate 6 is in down position. The front web-wing mounting plate 16, front web-foot support mounting plate 17, and rear web-wing mounting plate 18 are clearly visible in their respective positions. Locking mechanism 43 fastens swing front spreader 11.

Figure 6:
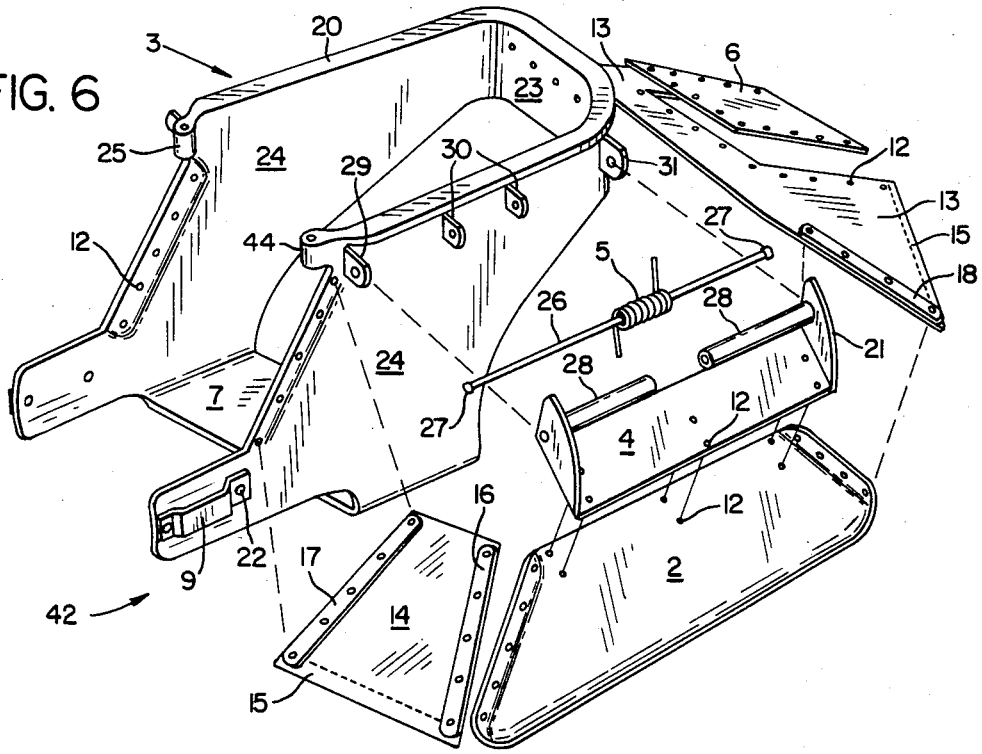

FIG. 6 shows an exploded view of the assembly of the boot add-on 42. The foot support 3 contains a foot support top 20, a rear foot support portion 23, two foot support side portions 24, stirrup 7, front spreader hinge 25, and lock pin receiver 44. In addition, forward wing attachment 29, mid-wing attachments 30, and aft-wing attachment 31 hold a pin 26 with enlarged pin end 27. The spring hinge 5 is positioned on the pin 26. The wing support 4, wing stop 21, and wing support cylinders 28 are all formed from a single piece of material. The belt loop fastener 22 attaches the belt loop 9 to the foot support side portion 24.

Figure 7:
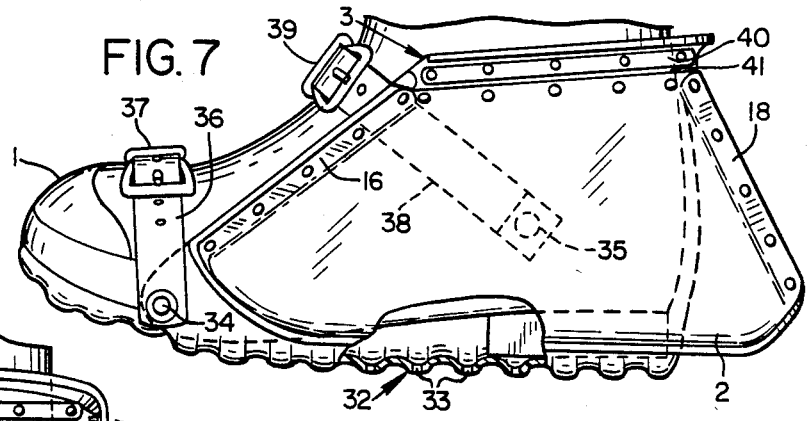
FIG. 7 is a side view of the fabric hinge boot add-on with bottom tread.

In FIG. 7 the bottom tread 32 is shown with the drain holes 33. The boot 1 is fastened to the foot support 3 by means of a toe strap 36 and an ankle strap 38. The ankle strap 38 is attached to the foot support 3 by means of ankle strap anchor 35. The toe strap 36 is attached to the foot support 3 by means of toe strap anchor 34. Toe strap fastener 37 and ankle strap fastener 39 hold the boot 1 in place in the foot support 3. The wing 2 is attached to the foot support 3 by means of the side wing mounting plae 40 and side wing fabric 41 with rivets 12.

Figure 8:
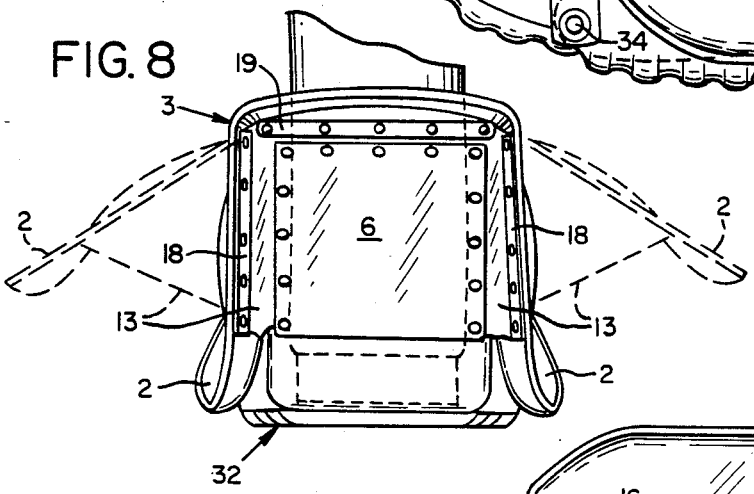
FIG. 8 is a rear view of the wings in rest positions.

FIG. 8 is a rear view showing the heel plate 6 along with the rear web-foot support mounting plate 19 and the rear web-wing mounting plate 18.

Figure 9:
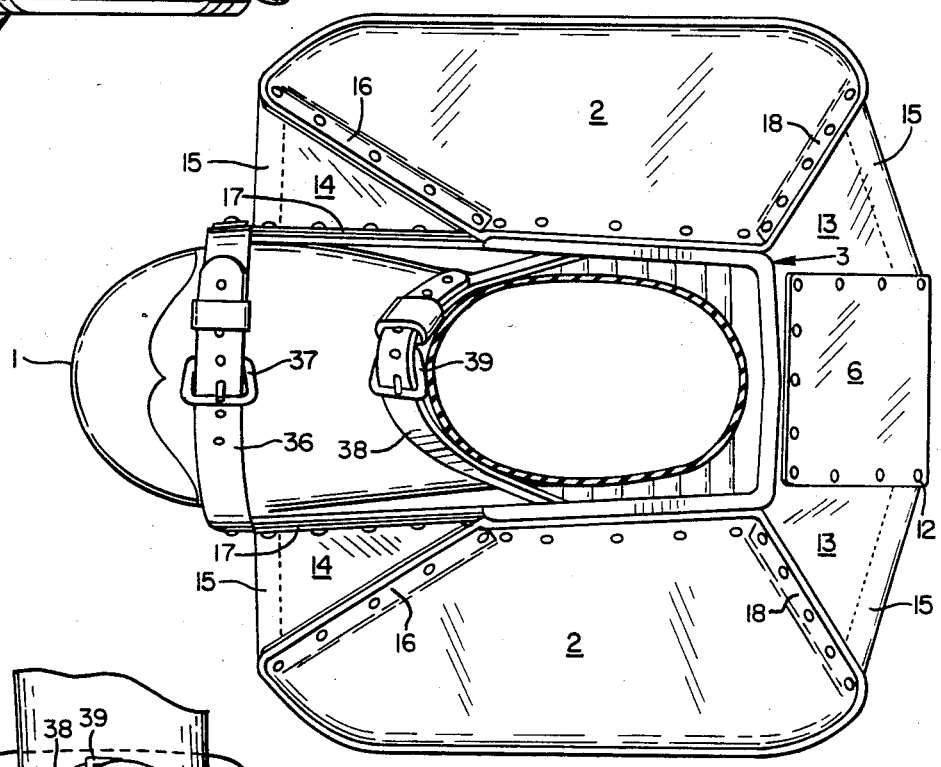
FIG. 9 is a top view showing the wings and expanding webs in open and spread position.

FIG. 9 shows open wings 2 along with the rear expanding web 13, heel plate 6, and front expanding plates 14.

Figure 10:
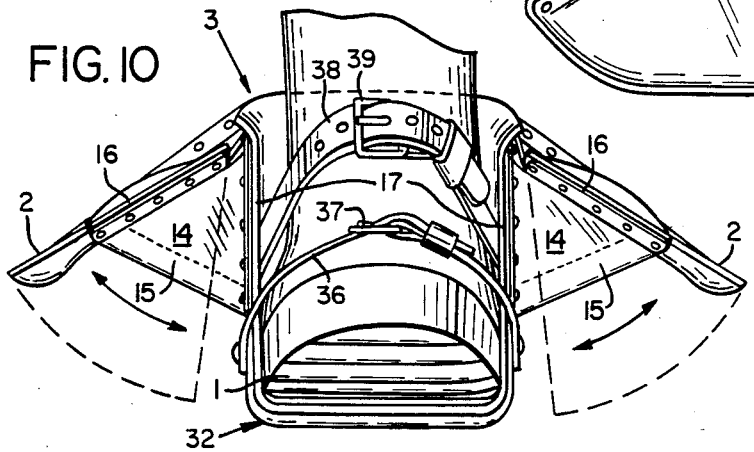
FIG. 10 is a front view showing the wings in open and in rest position.

FIG. 10 shows the front web-foot support mounting plate 17 and the front web-wing mounting plate 16 along with the clearest view of foot support 3.

FIGS. 1 through 10 show the embodiments as a boot add-on: specifically, the first embodiment is shown in FIGS. 1 through 6 and the second embodiment is shown in FIGS. 7 through 10. A boot incorporating the invention may be constructed by incorporating the foot support 3 within the boot itself. In the second embodiment the foot support 3 and tread 32 would be incorporated within the structure of the boot. In summary, the supporting structure becomes part of the boot.

In operation the wing 2 opens as the boot 1 is placed in the soft material, it flows between the foot support 3 and the underside of wing 2 causing the wing 2 to open. The surface area supporting the boot 1 is the bottom surface area of the boot, plus the surface area of each wing in open position in addition to the area of both front expanding webs 14, rear expanding web 13, and heel plate 6. When the wing 2 is in open position, the front expanding web 14 bears some of the pressure upon the wing 2 in its open position. Similarly, the rear expanding web prevents both wings 2 from fully opening. Thus, the rear expanding web 13 and the front expanding web 14 in conjunction with the wing stop 21 bear the load.

Among the difficulties in walking on soft materials is the suction and friction which forms between the bottom surface area and the soft material. In operation, the boot add-on traps the air within the chamber formed by the underside of the front expanding webs 14, wings 2, rear expanding web 13, heel plate 6, and foot support 3. As the soft material moves towards the underside of hinge 5, the air pressure increases. The trapped air under pressure counteracts the resistance due to suction and friction on the boot bottom. Additionally, the trapped air under pressure helps prevent the soft material from coating and fouling the hinges 5.

In the second embodiment shown in FIGS. 7 through 10, the rear expanding webs 13 and the front expanding webs 14 bear the entire load of the wearer. Note that the bottom tread 32 allows for the passage of water and/or other small material through the tread.

It is also apparent that the surface area available to carry the weight of the wearer is the area shown in top views of FIG. 2 and FIG. 9.

It is obvious to those skilled in the art the portions of the two embodiments may be interchanged or refined. For example, a hinge and stop mechanism could be formed from plastic rotating parts.

While the invention has been described by means of a specific example and in two specific embodments, I do not wish to be limited thereto, for obvious modifications will occur to those skilled in the art without departing from the spirit, scope and principles of this invention.

I claim:

1. In a boot or boot add-on the improvement comprising:

a. a front expanding web attached to a foot support by means of a front web-foot support mounting plate and attached to a wing by means of a front web-wing mounting plate where said foot support is pivotably attached to said wing; and b. a rear expanding web attached to said foot support by means of a rear web-foot support mounting plate and attached to said wing by rear web-wing mounting plate.

2. The improvement of claim 1 wherein said rear expanding web is additionally attached to a heel plate.

3. The improvement of claim 2 wherein two said front expanding webs, two said wings, said rear expanding web, said heel plate, and said foot support comprise a chamber.

4. The improvement of claim 1 wherein said foot support comprises a bottom tread with drain holes.

* * * * *